United States Patent [19]

Schofield

[11] Patent Number: 4,928,589

[45] Date of Patent: May 29, 1990

[54] SQUEEZE ROLL AND ACTUATOR ASSEMBLY UTILIZING INFLATABLE BAGS

[76] Inventor: Robert C. Schofield, 5520 Melton Rd., Portage, Ind. 46368

[21] Appl. No.: 206,347

[22] Filed: Jun. 14, 1988

[51] Int. Cl.[5] ..... B30B 3/04

[52] U.S. Cl. ..... 100/170; 68/258; 72/245; 92/35

[58] Field of Search ..... 100/47, 170, 176, 269 A, 100/163 R, 163 A, 168; 68/256, 259, 258; 29/113.1, 116.1; 92/34, 35, 37; 72/20, 243, 245

[56] References Cited

U.S. PATENT DOCUMENTS

| | | | |
|---|---|---|---|
| 2,475,894 | 7/1949 | Hermanny | 92/35 |
| 2,729,003 | 1/1956 | Cohn et al. | 68/258 X |
| 2,823,535 | 2/1958 | Warner | 100/170 X |
| 3,074,435 | 1/1963 | Woestemeyer | 92/35 |
| 3,143,772 | 8/1964 | Whitehurst | 100/170 X |
| 3,209,679 | 10/1965 | Crist et al. | 100/170 |
| 3,731,620 | 5/1973 | Klemmer | 100/170 X |

FOREIGN PATENT DOCUMENTS

| | | | |
|---|---|---|---|
| 1119809 | 12/1961 | Fed. Rep. of Germany | 100/170 |
| 109140 | 11/1943 | Sweden | 100/170 |
| 116366 | 1/1959 | U.S.S.R. | 68/258 |

*Primary Examiner*—Harvey C. Hornsby
*Assistant Examiner*—Stephen F. Gerrity
*Attorney, Agent, or Firm*—Burmeister, York, Palmatier & Zummer

[57] ABSTRACT

A differential pressure actuator includes two fluid containing bags mounted on opposite sides of a support bar, and one of the bags is coupled to a load by a plate at the side of the bag opposite the bar. The other bag is also coupled to the load by a second plate mounted at the opposite end of the other bag, and the second plate is mechanically connected to the first plate by a rod extending along the central axis of the first and second bags. Both of the bags contained a pressurized fluid in excess of atmospheric pressure, and the difference in the forces generated by the two bags is impressed upon the load. In one embodiment, the first and second bags are provided with a bellows surrounding the rod to seal the interior of the bag from ambient atmosphere. In another embodiment, the seal is provided by two sleeves coupled by a sealing ring. The load is a movable roller in a ringer for coating steel, and the movable roller is provided with separate actuators at opposite ends of the roller.

19 Claims, 4 Drawing Sheets

SQUEEZE ROLL AND ACTUATOR ASSEMBLY UTILIZING INFLATABLE BAGS

This is a continuation-in-part of application Ser. No. 07/086,281, filed Aug. 17, 1987, now U.S. Pat. No. 4,770.095 granted Sept. 13, 1988.

The present invention relates to devices for processing sheet material in which the sheet material is passed between a pair of abutting rolls, particularly squeeze rolls or wringers. The invention has particular utility in wringers for use in producing coated sheet steel. The invention also relates to an actuator which has particular utility for controlling the rolls of a sheet material squeeze roll, but has other applications also. The invention also relates to air bags having a sealed central aperture which have many other applications.

BACKGROUND OF THE INVENTION

In the inventor's co-pending U.S. patent application serial no. 07/086,281 entitled SQUEEZE ROLL AND ACTUATOR ASSEMBLY UTILIZING INFLATABLE BAGS, now patent no. 4,770,095, the inventor sets forth an actuator in which two inflatable bags are mounted at one end on opposite sides of a bar, and the opposite ends of the two bags are interconnected by a yoke utilizing a pair of rods disposed on opposite sides of the bags. The inflatable bags contain a fluid which is pressurized, and the force exerted on a load is derived from the yoke and is a function of the differential pressure of the fluid in the two bags. The present invention is an improvement on the devices of that patent.

It is an object of the present invention to provide an actuator suitable for use with squeeze rolls which is more responsive than actuators previously known. The actuator of the inventor's prior patent, referred to above, is a marked improvement over prior devices, but the present invention provides an actuator which is significantly more responsive to the type of roll deflection which occurs in processing sheet material through a squeeze roll. Such operations require constant pressure on the sheet as it rolls through the rolls, and accordingly, a variation in the sheet must produce a rapid adjustment by the actuator to prevent an excessive change in pressure by the rolls. The actuator of the present invention increases responsiveness over the inventor's prior actuator by reducing the mass of the moving structure of the actuator.

It is also an object of the present invention to reduce the size and cost of the actuator over that of the inventor's prior construction. In addition, the inventor seeks to provide a simpler and less costly positive stop to the actuator and a more reliable construction for pressurizing the inflatable bags.

THE INVENTION

The inventor has found that two bags mounted in opposition and provided with a fluid medium at a pressure in excess of atmospheric pressure can achieve superior operating characteristics over a single bag provided with a fluid medium, and that the two bags are preferably interconnected by a single post disposed centrally of the two bags. The fluid is preferably a gas, such as air, but it may also be a liquid or a combination of a gas and a liquid depending upon the application. An actuator having a central support bar which supports two bags on opposite sides thereof, positions the fluid bags for interconnection by a single post attached to the end of one of the bags remote from the bar and coupled to the end of the other bag remote from the bar. This structure reduces the moving mass, and provides an actuator with an improved response both in terms of time and accuracy. It is necessary to retain a fluid tight seal to each of the fluid bags while permitting the post to be freely translatable along its axis, and the inventor has found that this can best be achieved by a hollow extensible sealing device extending between opposite ends of each of the fluid bags and surrounding the portion of the post traversing that fluid bag. Two extensible seals are described, namely, a bellows and a ring disposed between two coaxially disposed hollow cylinders of different diameters. The inventor has also found that the response time of the actuator may be further improved by decoupling one of the fluid bag for short interval deviations in the load and restoring the effectiveness of the bag for longer intervals.

The invention also contemplates use of two actuators of the type described above to control the squeeze rolls whether for use in the production of sheet steel, aluminum, or other metals, or in the paper industry, film industry or other application. In most applications, a pair of identical actuators is employed and the corresponding fluid bags of the two actuators are pneumatically or hydraulically interconnected to produce approximately the same force.

DESCRIPTION OF THE DRAWINGS

For a more complete understanding of the present invention, a specific embodiment of the invention is set forth hereinafter and in the accompanying drawings, in which.

DETAILED DESCRIPTION OF THE INVENTION

Figure 1:
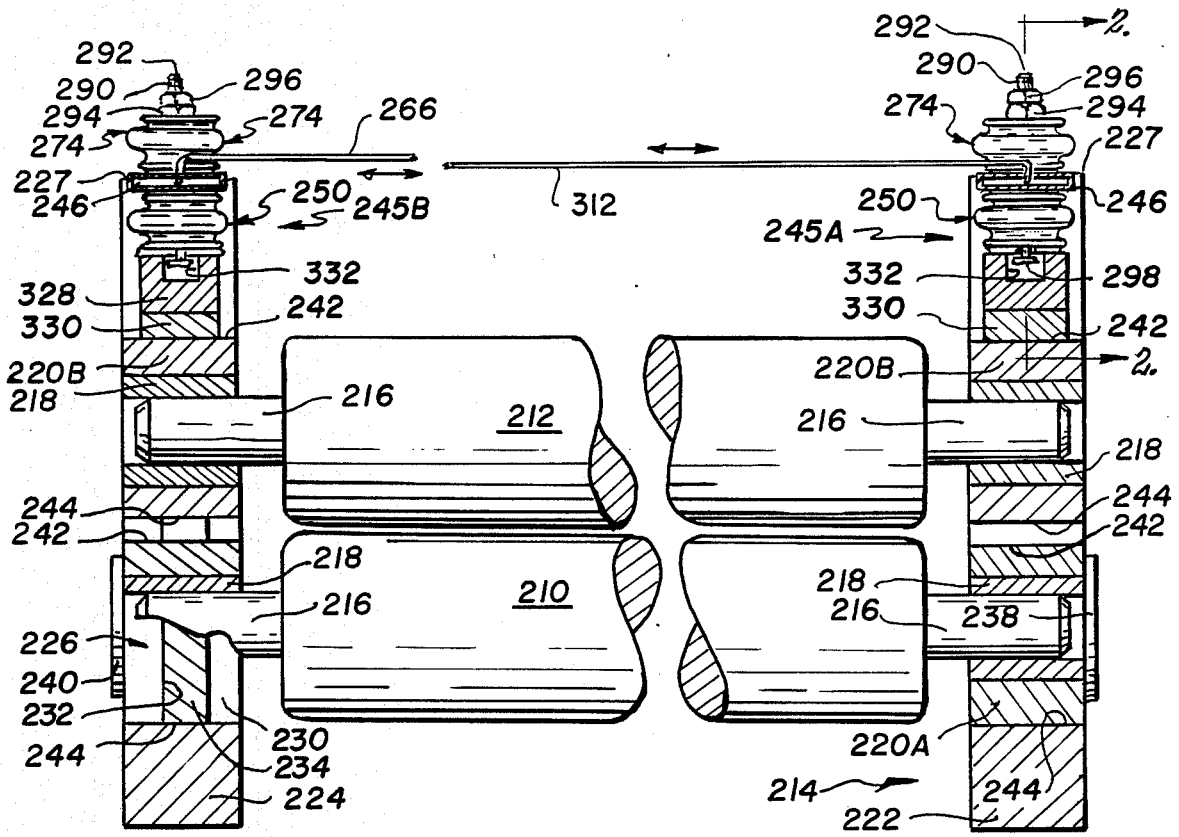
FIG. 1 is a sectional view of a roller assembly and actuator constructed according to the teachings of the present invention.

As illustrated in FIG. 1, a pair of rolls 210 and 212 are horizontally mounted on a support structure 214. The rolls 210 and 212 are cylindrical, of the same diameter, and constructed of steel. Each of the rolls 210 and 212 has stems 216 outwardly extending from opposite ends thereof, and the stems are journaled within bearings 218 carried by bearing blocks 220A and 220B, respectively.

The support structure 214 has two walls 222 and 224 disposed parallel to each other, and the walls 222 and 224 are each provided with a recess 226 extending therein from the top 227 of the wall 222 or 224. Each of the recesses 226 is provided with opposing vertical parallel sides 228 and 230, and the sides 228 and 230 are provided with an elongated slot 232 which extends therein to form a keyway. The bearing blocks 220A and 220B have flanges 234 extending outwardly therefrom on opposite sides which are translatably disposed within the slots 232 of the sides 228 and 230 of the recess 226, thereby making the bearing blocks 220A and 220B translatable within the recess 226. The bearing blocks 220A of the roll 210, however, are anchored on the walls 222 and 224 by plates 238 and 240 mounted on the walls 222 and 224 and secured to the bearing blocks 220A of the roll 210. Hence the roll 210 is anchored on the support structure 222 and is the stationary roll.

The bearing blocks 220A and 220B are identical, and are provided with an upper surface 242 and a lower surface 244, the surfaces 242 and 244 being normal to the sides 228 and 230 of the recess 226 and horizontal. When the rolls 210 and 212 are in abutment, significant space exists between the upper surface 242 of the movable bearing blocks 220B and the top 227 of the wall 222 and 224 and actuator mechanisms 245A or 245B are disposed in these regions, respectively.

Each of the actuator mechanisms 245A and 245B has a rectangular elongated hollow support tube or bar 246 which is mounted on the top 227 of the wall 222 or 224 in an indentation 248 thereof as by bolts 249, and the tube 246 extends horizontally across the recess 226. A first air bag 250 is mounted on the lower side of the tube 246 and extends downwardly toward the bearing block 220B. The air bag 250 has two opposed ends 252 and 254, the end 252 being mounted on the lower side of the tube 246. A resilient flexible wall 256 extends from the end plate 252 to the end plate 254 and forms a sealed chamber 258. A stem 260 extends through the end plate 252 into the tube 246, extends along the tube toward the wall 228, and exits from the tube through an orifice 261 to a closure 262, thereby providing a means for pressurizing the chamber 258. A compressed air source is either permanently or temporarily connected to the stem 260 to pressurize the chamber 258 and inflate the air bag 250 to a desired pressure, inflation of the air bag causing the end plates 252 and 254 to become displaced further from each other. In the construction illustrated, the end plates 252 and 254 of the air bag 250 are at all times too close to each other to provide optimum geometry for the chamber 258 so that any shortening of the distance between the end plates 252 and 254 decreases the volume of the chamber 258 and increases the pressure of the air within that chamber.

Separate actuator assemblies 245A and 245B of identical construction are mounted on the walls 222 and 224 and exert pressure on the bearing blocks 220B at opposite ends of the movable roll 212 to force that roll toward the stationary roller 210. The stem 260 is provided with a T connector 264 adjacent to the closure 262 and the T connector 264 of actuator assembly 245A is connected by the tube or line 266 to the T connector 264 of the actuator assembly 245B, thereby interconnecting the chambers 258 of the two actuator assemblies and maintaining these chambers 258 at the same fluid pressure.

The air bag 250 itself is a well-known commercial product available from Firestone Industrial Products Company of Noblesville, Ind.

Figure 4:
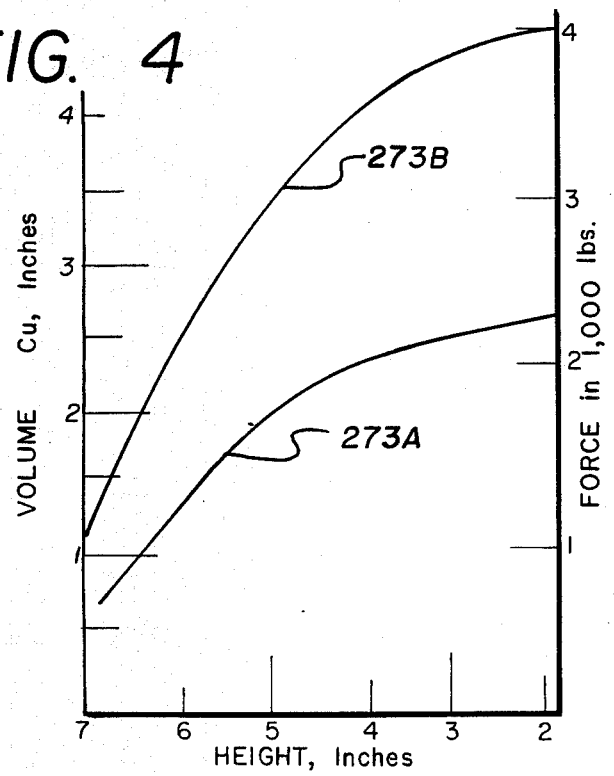
FIG. 4 is a graph illustrating the change in volume with respect to a change in height of one of the air bags at fixed pressure.

As illustrated in FIG. 4, for a given air pressure, the air bag 250 will have a relatively small change in volume when the height or distance between the ends 252 and 254 changes in the range at the far right of the graph, namely, two to three inches, but a change in volume accelerates when the height in inches is greater. Since the volume change determines the pressure change within the air bag 250, it is usually desirable to operate the air bag in a region where the curve is relatively flat, namely, in the upper right portion of the curve. The shape of the curve is determined by the geometry of the air bag and the flexibility of the air bag walls. FIG. 4 illustrates two curves 273A and 273B operating at different pressures. The lower curve 273A is flatter but is for a lower pressure. The upper curve 273B provides much greater force.

The structure of the actuators 245A and 245B described to this point is effective to control the roll 212 with respect to the roll 210. However, the complete structure illustrated in the figures provides more accurate adjustment of the force on roll 212 with respect to roll 210 and limits the permissible movement of roll 212 with respect to roll 210. In addition, it permits the air bag 250 to be operated at higher pressure.

Figure 2:
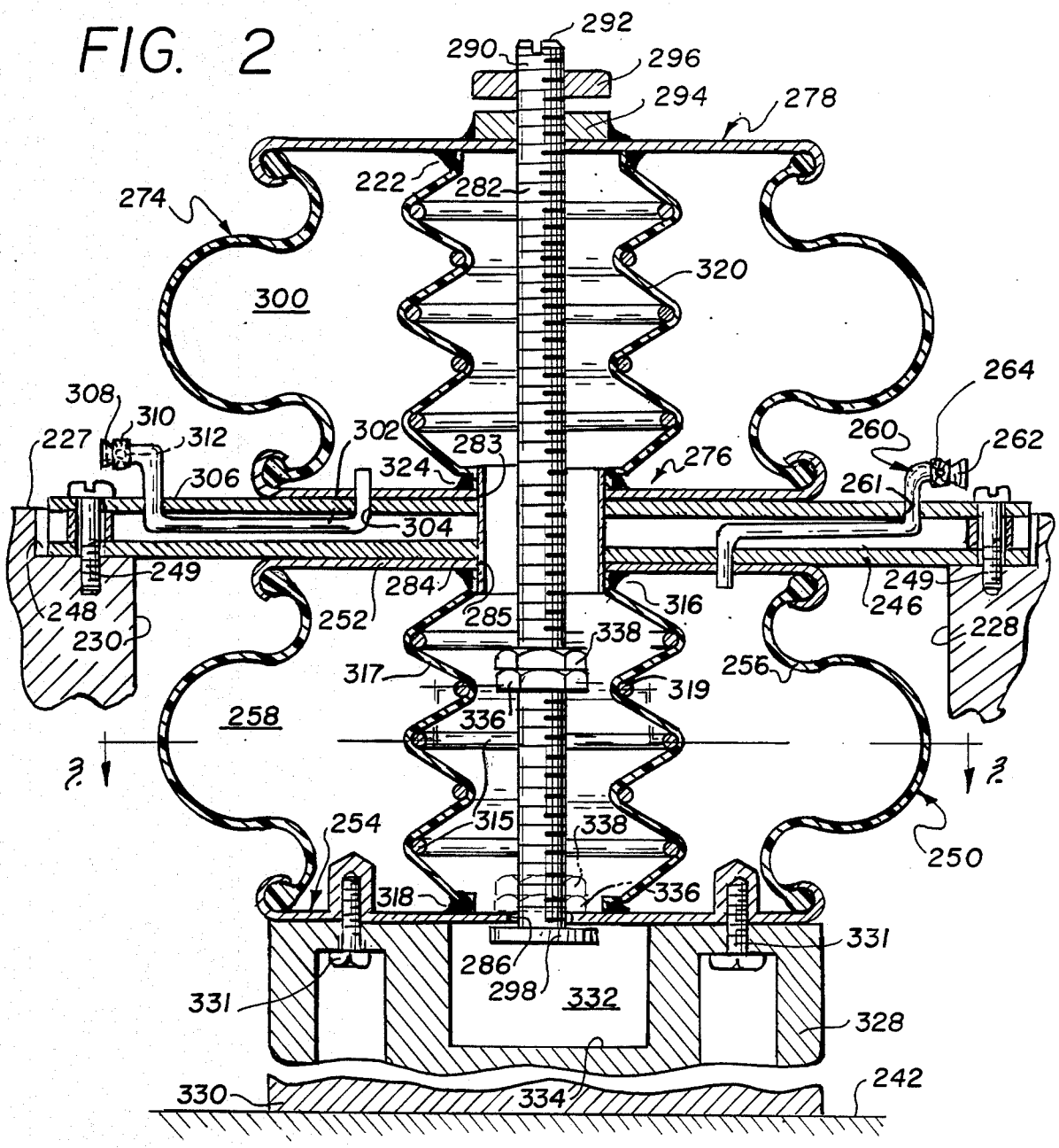
FIG. 2 is a sectional view of the actuator illustrated in FIG. 1 taken along the line of 2—2 of FIG. 1.

As illustrated in FIGS. 1 and 2, the second air bag 274 is mounted on the upper side of tube 246 and extends upwardly therefrom, the second air bag 274 having one end plate 276 mounted on the upper side of tube 246. The air bag 274 has an opposite end plate 278 which is generally parallel to the tube 246. A post 282 is mounted on the end plate 278 of the air bag 274 and extends along the axis of the air bag 274 downwardly through an opening in the end plate 276, an opening 284 in the tube 246, an opening 285 in the end plate 252 of the air bag 250 and an opening 286 in the end plate 254 of the air bag 250. The post 282 has threads 290 at its upper end 292, and the post is anchored on the end plate 278 of the bag 274 by a captive nut 294 secured on the upper side of the end plate 278. The post 282 may be adjusted by rotation in the captive nut to control the distance between the plate 278 and the end of the post opposite the end plate 278, and a lock nut 296 is provided to secure the post in position. The post 282 has a circular flange 298 at its end confronting the side of the end plate 254 opposite the tube 246, and the flange 298 abuts the end plate 254 to limit the upward movement of the post 282. Hence, the post 282 forms a linking member for transmitting force between the end plate 278 of the air bag 274 and the end plate 254 of the air bag 250.

The bag 274 defines a chamber 300 which communicates with a stem 302 through an aperture 304 in the end plate 276, and the stem 302 extends through the tube 246 to a second aperture 306 and terminates in a plug 308. The bag 274 is pressurized by connecting an air source, not shown, to the stem at the plug. The stem 302 is provided with a T-connector 310 adjacent to the plug 308, and a line 312 interconnects the bags 274 of the two actuators 245A and 245B.

Figure 3:
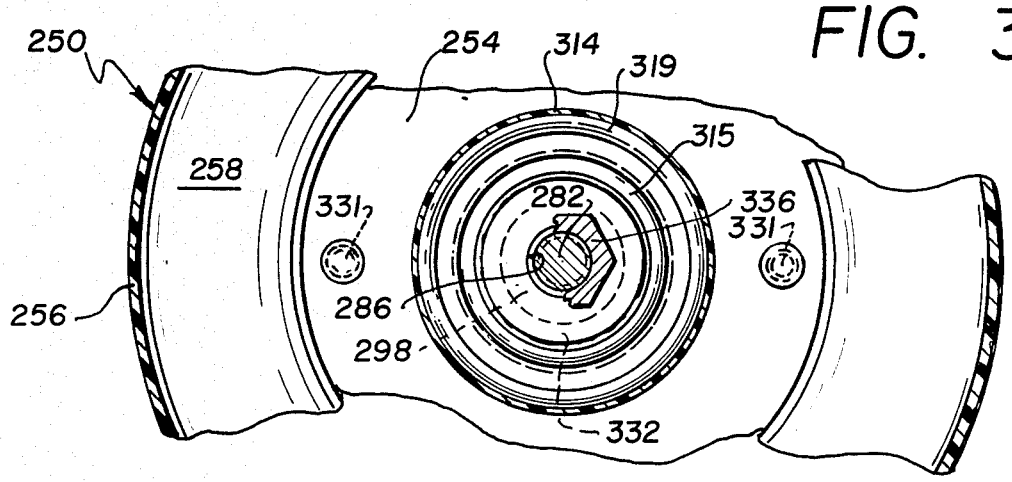
FIG. 3 is a sectional view taken along the line of 3—3 of FIG. 2.

In order to maintain differential pressures in the bags 250 and 274, it is necessary to provide a means to seal the bags from each other as well as the ambient atmosphere. In the construction of FIGS. 1 through 3, the bag 250 is provided with a bellows 314 which surrounds the post 282 and a seal 316 at one end engaging the end plate 252 about the perimeter of the opening 285 and a second seal 318 at the other end engaging the end plate 254 about the perimeter of the opening 286. The seals 316 and 318 may be of any of the conventional construction and may simply constitute a ring of cement. The bellows thus forms a hollow extensible means for surrounding the post 282 and sealing the chamber 258 from the atmosphere and other portions of the actuator.

The bellows 314 is provided with a first group of rings 315 which are disposed on the inner side of a flexible tube 317, and a second group of rings 319 on the outer side of the flexible tube 317. The rings 319 are of smaller diameter than the rings 315, and are disposed between adjacent rings 315 of the first group. The rings 315 and 319 are generally parallel to each other and normal to the axis of the rod 282, and the rings 315 and 319 are approximately equally spaced from each other, thereby providing an essentially accordian-shaped bellows which is readily extensible and which will resist collapse. The rings 315 and 319 are secured on the tube 317 as by cement or bonding.

In like manner, a bellows 320 identical to the bellows 314 is disposed within the bag 274 surrounding the post 282. The bellows 320 has a seal 322 at its upper end engaging the end plate 278 coaxially about the post 282, and a second seal 324 at the lower end engaging the end plate 276 about the perimeter of the opening 283. The bellows 320 and the bag 274 thus form the air tight chamber 300 which is extensible.

As illustrated in FIG. 1, each actuator 245A and 245B is coupled to a bearing block 220B by a load block 328 and a spacer block 330. The load block 328 is mounted on the end plate 254 by a pair of bolts 331 and provided with a cylindrical recess 332 confronting the flange 298. The recess 332 permits the flange 298 and post 282 to be translated downwardly and away from the end plate 254 of the bag 250 until the flange 298 abuts the bottom 334 of the recess 332. Thus a deflection of the roll 212 will work against the total force from the bag 250 until the flange 298 moves into abutment with either the bottom 334 of the recess 332 or the movement limits of end plate 254 of the bag 250. As illustrated in FIG. 2, short interval (fractions of a second) movements of the roll 212 in response to irregularities in the material being processed will cause the roll 212 to be solely in the control of bag 250, and bag 274 will only be engaged by longer time interval variations (note short time is in increments of 1/10,000 second).

Bag 274 is pressurized in chamber 300 either at a greater or lower pressure than bag 250 (chamber 258) as desired so that the long time or normal force on the load block 328 translated to roll 212 through bearing 220B is the desired squeeze force between rolls 212 and 210. A pressure in bag 274 (chamber 300) less than bag 250 (chamber 258) will translate into a squeeze force between rolls 212 and 210 greater than the force exerted by the weight (mass) of roll 212 approximately equal to the difference between (the pressure in chamber 258 times the area of plate 254) less (the pressure in chamber 300 times the area of plate 278).

A pressure in bag 274 (chamber 300) greater than bag 250 (chamber 258) will translate into a squeeze force between rolls 212 and 210 less than the force exerted by the weight (mass) of roll 212 approximately equal to the difference between (the pressure in chamber 300 times the area of plate 278) less (the pressure in chamber 258 times the area of plate 254).

For example: a protuberance the size of a pin head in a sheet of material passing between rolls 212 and 210 at a speed of 1,600 feet per minute will pass the line of squeeze (line of pressure force between roll 212 and 210) in approximately 1/5,000 of a second. The squeeze pressure between rolls 212 and 210 has been set to the desired force to remove fluids from the sheet material by either pressurizing bag 250 (chamber 258) to increase the squeeze force or pressurizing bag 274 (chamber 300) to decrease the squeeze force exerted by the weight (mass) of roll 212 (and also all rigidly attached items such as bearing 220B). The response of the actuator to protuberances (bumps) on the sheet material is set by increasing equally (approximately) the pressure in both bag 274 (chamber 300) and bag 250 (chamber 258) to the pressure point desired in bag 250 (chamber 258) for resistance to and rebound from movements of roll 212 translated through bearing block 220B, load block 328 and spacer 330. The increased pressurizing of bag 274 in conjunction with bag 250 retains the desired normal squeeze pressure between rolls 212 and 210. The pin head size protuberance upon reaching the intersecting squeeze line between roll 212 and 210 forces roll 212 away from roll 210 to allow the protuberance to pass between the rolls. Both this movement of roll 212 away from roll 210 and the return of roll 212 to its normal position after the protuberance has passed (approximately 1/5,000 of a second) is now controlled by the elevated pressure force of bag 250. The result from both the lowered mass (inertia) of the portion of the actuator actually moved by the protuberance and the elevated pressure in bag 250 causes roll 212 to be outside of the desired position and not exerting the desired squeeze force for a very short time (approximately 1/5,000 of a second) thereby properly maintaining the desired normal squeeze force for the greatest operating time.

Note: flange 298 of post 282 can be rigidly attached to plate 254 of bag 250. The result of such an attachment would be to increase the inertial mass which would because of the greater inertia delay the return to normal force of roll 212.

FIG. 2 illustrates the post 282 with threads 290 extending from the flange 298 to the opposite end 292 and a pair of lock nuts 336 and 338 engaging each other to maintain these lock nuts at a distance from the end plate 254 sufficient to permit the post 282 to travel and position the flange between the end plate 254 and the bottom 334 of the recess 332. The lock nuts 336 and 338 rotated down the post 282 to engage the end plate 254, as shown in dotted lines in FIG. 2, thus locking the post on the end plate 254. By securing the post 282 on both end plates 254 and 278, the positive or negative effect of the bag 274 on the force exerted on the roller 212 will be present at all times. It is generally preferable to use the bags 250 and 274 differentially, that is, to reduce the force exerted by the bag 250 on the roll 212 by the force produced by the bag 274 and to have changes in these forces additive on the roll 212 in order to provide a more uniform slope to the force displacement curve of the combined actuator.

It will be noted that the actuators 245A and 245B add very little mass which must be moved in response to a deflection of the roller 212, the movable mass being principally in the post 282, bags 250 and 274, and bellows 314 and 320, thus assuring a rapid response to deflection of the roller 212. When the lock nuts 336 and 338 are displaced from the end plate 254, as illustrated in solid lines in FIG. 2, that movable mass is further reduced for upward deflections of the roll 212, since the mass of the rod 282, bag 274 and bellows 320 are effectively decoupled. Further, both ends of the roll 212 are subjected to approximately the same force from the actuators 245A and 245B, since the actuators are a matched pair by design and construction and the chambers 258 are pneumatically interconnected and the chambers 300 are pneumatically interconnected.

Figure 6:
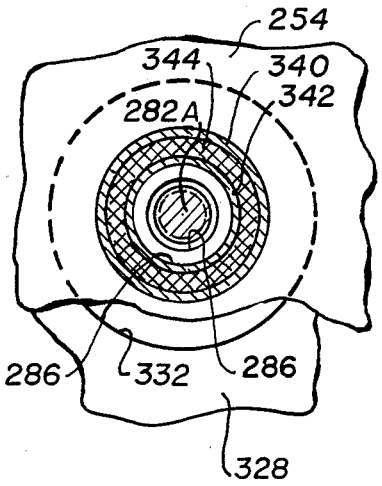
FIG. 6 is a fragmentary sectional view taken along the line of 5—5 of FIG. 5.
Figure 5:
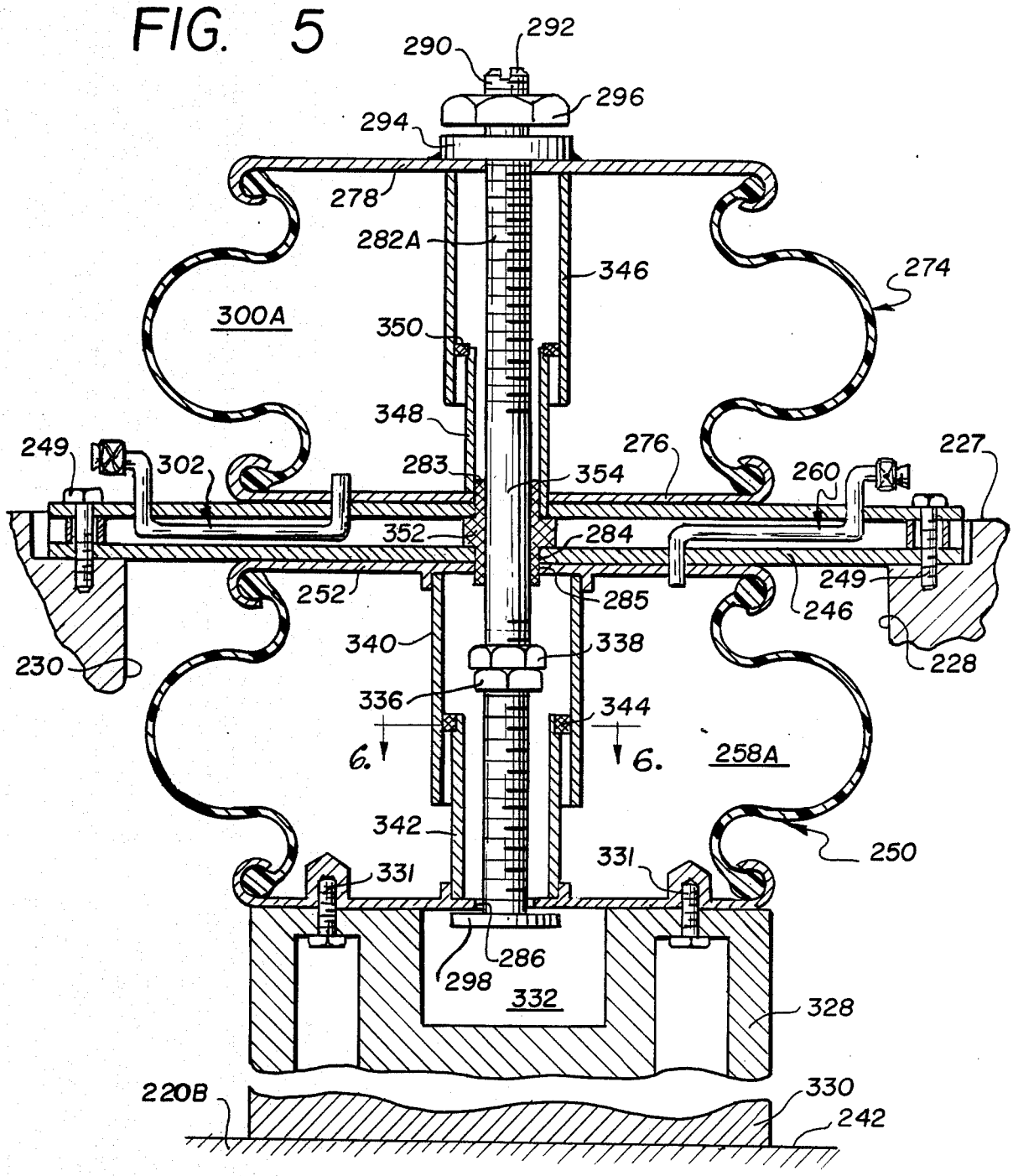
FIG. 5 is a sectional view of another embodiment of an actuator constructed according to the teachings of the present invention taken in the same plane as FIG. 2.

FIGS. 5 and 6 illustrate another embodiment of the present invention which utilizes extensible seal employing a sealing ring. To the extent that elements of the embodiment are identical to those of the embodiment of FIGS. 1 through 3, like reference numerals will be employed and these elements will not be further described.

In the embodiment of FIGS. 5 and 6, the bellows and seals are omitted from the interior of the bags 250 and 274. In bag 250, two linear hollow tubes 340 and 342 of different diameters are disposed coaxially about a post 282A which differs from the post 282 of the construction of FIGS. 1 through 3 only in that the central portion is unthreaded and cylindrical as will be described hereinafter. The tube 340 has one end mounted and sealed on the end plate 252 coaxially about the opening 285 therein, and the tube extends downwardly and terminated at a distance from the end plate 254. The tube 342 has a smaller outer diameter than the inner diameter of the tube 340, and the tube 342 is mounted at one end on the end plate 254 about the perimeter of the opening 286. The tube 342 extends upwardly from the end plate 254 into the interior of the tube 340, and a sealing ring 344 is mounted on the other end of the tube 342. The sealing ring 344 has an inner perimeter which engages the outer wall of the tube 342 and an outer perimeter which engages the inner wall of the tube 340, thus forming a seal and providing with the tubes 340 and 342 a fluid tight extensible structure.

An identical extensible fluid tight structure is provided about the post 282A in the bag 274 by a hollow tube 346 mounted on the end plate 278 , a hollow tube 348 mounted on the end plate 276, and a ring 350 mounted on the end of the tube 348 and engaging the inner wall of tube 346 and the outer wall of tube 348. The extensible seal using tubes 346 and 348 provides a larger chamber, designated 300A, within bag 274 than the chamber 300 of the embodiment of FIGS. 1 through 3 using a bellows. Likewise the chamber within bag 250, designated 258A, is larger than the chamber 258 of FIGS. 1 through 3.

A cylindrical bearing 352 is mounted within the openings 283, 284 and 285 in the end plate 276, tube 246 and end plate 252, and the post 282A is journaled within the bearing 352. The central portion 354 of the post 282A is not threaded and is cylindrical to permit proper journalling of the post 282A. The bearing 352 assures symmetrical operation of the bags 250 and 274, and smooth translation of the post 282A.

Figure 7:
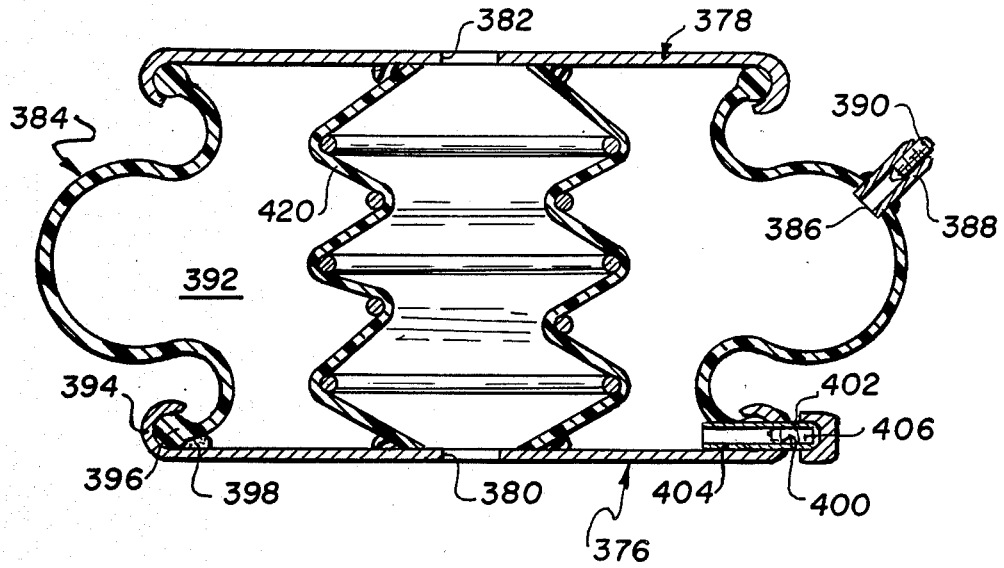
FIG. 7 is a sectional view of a modified fluid bag construction for use in the embodiments of FIGS. 1 through 6.

FIG. 7 illustrates a modified form of fluid bag which may be used in substitution of the fluid bags 258 and 300 of FIG. 2 and 258A and 300A of FIG. 5. The fluid bag of FIG. 7 is a modification of that illustrated in FIG. 2 in that it is provided with two alternate constructions for accessing the interior of the bag to pressurize the bag.

The embodiment of FIG. 7 is provided with end plates 376 and 378, the end plates having openings 380 and 382, respectively. A bellows 384 constructed in the manner of FIG. 2 is sealed about the opening 380 in the end plate 376 and about the opening 382 in the end plate 378. A flexible wall 384 is sealed at the perimeter of the end plates 376 and 378 and extends therebetween in the manner of the bag of FIG. 2.

The wall 384 is provided with an aperture 386 centrally thereof, and a stem 388 extends outwardly from the aperture. A valve 390 is disposed within the stem 388, and when a source of fluid under pressure, such as air, is connected and sealed on the stem 388, the valve 390 opens permitting the fluid to flow down the stem 388 and through the aperture 386 into the interior of the wall 384, the interior being designated 392.

A second port or access to the region 392 within the wall 384 is provided through the end plate 376. The end plates 376 and 378 have a curved lip 394 at their perimeters, and the curved lip partially surrounds a bead 396 at the ends of the wall 384, thereby mechanically securing the wall 384 to the end plates 376 and 378. In addition, the beads 398 are cemented in place by cement illustrated at 398.

The circular flange 394 is provided with an aperture 400, and a stem 402 extends through the aperture 400 into the interior 392 of the wall 384, the bead 394 being disposed adjacent to the stem and sealed about the stem with cement 404. The stem 402 is provided with a cap 406 when not in use to seal the interior 392 of the wall 384 from the ambient atmosphere, thereby permitting the bag of FIG. 7 to be permanently pressurized, or to be interconnected with, a pressure source at the discretion of the operator.

It will be recognized that the bellows 384 of the fluid bag of FIG. 7 provides an inner channel to accommodate a force transmitting member such as a rod or a flexible inextensible member, such as a chain mounted on the end plate 378 and depending through the opening 380 in the end plate 376. If its is not necessary to utilize a force transmitting member in a particular application, the bellows 384 may be omitted, and the apertures 380 and 382 omitted, thereby providing a sealed interior chamber 392 without a bellows. In such a structure, the access tubes 402 or 388, or both, are available to inflate or otherwise fill the fluid bag.

Those skilled in the art will devise modifications of the structures herein described and applications of the present invention in addition to those set forth herein. The differential actuator is not limited in its application to squeeze roll control, or to control of roll tables or devices, even though it has great utility in these application. The invention contemplates use of the differential applicator in any application requiring carefully controlled or adjusted forces, either as a permanently or semi-permanently charged device or a device connected to a source of gas pressure. The inventor also contemplates that an air bag with a sealed central hollow shaft between each bag end will have great utility in applications other than the differential actuator application. Hence it is not intended that the scope of this invention be limited by this specification, but rather only by the appended claims.

The invention claimed is:

1. A roll assembly for sheet material comprising a support structure adapted to be disposed on a horizontal surface, said support structure defining a pair of spaced confronting keyways extending vertically upward from a lower end thereof, a first bearing block mounted in a fixed position on the support structure at the lower end of one of the keyways and a second bearing block mounted in a fixed position on the support structure at the lower end of the other of the keyways, a first roll having a central axis of elongation journaled at opposite ends on the first and second bearing blocks, a third bearing block translatably keyed within the one keyway and a fourth bearing block translatably keyed within the other keyway of the pair of keyways, a second roll having a central axis of elongation journaled at opposite ends on the third and fourth bearing blocks, the axes of elongation of the first and second rolls being disposed in a vertical plan, the third and fourth bearing blocks and the second roll forming an assembly translatable in the keyways and movable with respect to the first roll, an actuator having a first support bar extending across the one keyway of the pair of keyways above the third bearing block and mounted on the support structure, said bar having an underside confronting the third bearing block and an upperside opposite the underside, said actuator having a first bag having opposite ends and a flexible elastic wall extending between ends thereof defining a first cavity, one end of the first bag being mounted in a fixed position on the underside of the bar and extending toward the third bearing block, means connecting the other end of the first bag to the third bearing block, a second bag having opposite ends and a flexible elastic wall extending between the ends thereof defining a second cavity, one end of the second bag being mounted on the upper side of the bar and the second bag extending away from the third bearing block, a mechanical linking member attached to the other end of the first bag and coupled to the other end of the the second bag, said linking member extending through the cavities of the first and second bags for transmitting force from the other end of the first bag to the other end of the second bag, the cavities having fluid therein at a pressure above atmospheric pressure, the volume of the cavities of the first and second bags being a direct function of the distance between the ends thereof and the fluid pressure within the first and second cavities, whereby the actuator exerts a force on the third bearing block which is a direct function of the pressure difference of the fluid within the first cavity and the second cavity.

2. A roll assembly for sheet material comprising the combination of claim 1 wherein the linking member comprises a flexible inextensible cable attached at its one end to the other end of the first bag and attached at its other end to the other end of the second bag.

3. A roll assembly for sheet material comprising the combination of claim 1 wherein the linking member comprises a rigid rod.

4. A roll assembly for sheet material comprising the combination of claim 3 wherein the other end of the first bag carries an end plate, the end plate having an orifice therein, the rod being translatably disposed in the orifice of the end plate of the first bag, the means for coupling the rod to the other end of the first bag comprising a flange extending outwardly from the rod on the opposite side of the end plate from the bar and being adapted to abut the perimeter of the end plate surrounding the orifice thereof.

5. A roll assembly for sheet material comprising the combination of claim 4 wherein the means connecting the other end of the first bag to the third bearing block comprises a load bearing block mounted in abutment with the end plate at the other end of the first bag, the load bearing block having a recess confronting the orifice in the end plate, and the rod and the flange thereof being translatable within the recess.

6. A roll assembly for sheet material comprising the combination of claim 1 in combination with a fluid tight hollow extensible member having first and second opposite ends, the first of said ends being sealed on the one end of the first bag and the second of said ends being sealed on the other end of the first bag, the mechanical linking member extending through the hollow extensible member.

7. A roll assembly for sheet material comprising the combination of claim 6 in combination with a second fluid tight hollow extensible member having first and second opposite ends, the first of said ends being sealed on the one end of the second bag and the second of said ends being sealed on the other end of the second bag, the mechanical linking member extending through the first and second hollow extensible members.

8. A roll assembly for sheet material comprising the combination of claim 6 or 7 wherein the fluid tight extensible hollow member comprises a bellows.

9. A roll assembly for sheet material comprising the combination of claim 6 or 7 wherein the fluid tight extensible hollow member comprises a first hollow sleeve having spaced opposite ends and a second hollow sleeve having spaced opposite ends, the one end of the first sleeve being sealed on the one end of a bag and the other end of the other sleeve being sealed on the other end of said bag, the first and second sleeves being coaxially disposed and the other end of the second sleeve extending into the first sleeve, and a sealing ring mounted on one of the sleeves and disposed between an inner surface of the first sleeve and an outer surface of the second sleeve, the first and second sleeves being translatable with respect to each other.

10. A roll assembly for sheet material comprising the combination of claim 1 in combination with a second actuator having a second support bar extending across the other keyway of the pair of keyways above the fourth bearing block and mounted on the support structure, said second bar having an underside confronting the fourth bearing block and an upperside opposite the underside, said second actuator having a third bag having opposite ends and a flexible elastic wall extending between ends thereof defining a third cavity, one end of the third bag being mounted in a fixed position on the underside of the second bar and extending toward the fourth bearing block, means connecting the other end of the third bag to the fourth bearing block, a fourth bag having opposite ends and a flexible elastic wall extending between ends thereof defining a fourth cavity, one end of the fourth bag being mounted on the upper side of the second bar and the fourth bag extending away from the fourth bearing block, a mechanical linking member attached to the other end of the fourth bag and coupled to the other end of the third bag, said linking member extending through the cavities of the third and fourth bags for transmitting force from the other end of the third bag to the other end of the fourth bag, the third and fourth cavities having fluid therein at a pressure above atmospheric pressure, the volume of the cavities of the third and fourth bags being a direct function of the distance between the ends thereof and the fluid pressure within the third and fourth bags, whereby the second actuator exerts force on the fourth bearing block which is a direct function of the pressure difference of the fluid within the third cavity and the fourth cavity.

11. An actuator for exerting a force against a load comprising, in combination, a support bar mounted in a fixed position with respect to the load having one side and an opposite side, a first bag having opposite ends and a flexible elastic wall extending between the ends thereof defining a first cavity, one end of the first bag being mounted in a fixed position on the one side of the bar and extending outwardly from said side, the other end of the first bag carrying said load, a second bag having opposite ends and a flexible elastic wall extending between the ends thereof defining a second cavity, the one end of the second bag being mounted on the other side of the bar and the second bag extending away from said other side of the bar, a mechanical linking member attached to the other end of one of the bags and coupled to the other end of the other of the bags, said linking member extending through the cavities of the first and second bags for transmitting said force from the other end of the first bag to the other end of the second bag, said cavities having fluid therein at a pressure above atmospheric pressure, the volume of the cavities of the first and second bags being a direct function of the distance between the ends thereof and the fluid pressure within the first and second bags, whereby the actuator exerts said force on the load which is a direct function of the difference in the pressures of the fluid within the first cavity and the second cavity.

12. An actuator comprising the combination of claim 11, wherein the linking member comprises a flexible inextensible cable attached at its one end to the other end of the first bag and attached at its other end to the other end of the second bag.

13. An actuator comprising the combination of claim 11 wherein the linking member comprises a rigid rod.

14. An actuator comprising the combination of claim 13 wherein the other end of the first bag carries an end plate, the end plate having an orifice therein, the rod being translatably disposed in the orifice of the end plate, the means for coupling the rod to the other end of the first bag comprising a flange extending outwardly from the rod on the opposite side of the end plate from the bar and being adapted to abut the perimeter of the end plate surrounding the orifice thereof.

15. An actuator comprising the combination of claim 14 wherein the means connecting the other end of the first bag to a load comprises a load being block mounted in abutment with the end plate at the other end of the first bag, the load bearing block having a recess confronting the orifice in the end plate, and the rod and the flange thereof being translatable within the recess, the flange being movable between the load bearing block and the end plate.

16. An actuator comprising the combination of claim 11 in combination with a fluid tight hollow extensible member having first and second opposite ends, the first of said ends being sealed on the one end of the first bag and the second of said ends being sealed on the other end of the first bag, the mechanical linking member extending through the hollow extensible member.

17. An actuator comprising the combination of claim 16 in combination with a second fluid tight hollow extensible member having first and second opposite ends, the first of said ends being sealed on the one end of the second bag and the second of said ends being sealed on the other end of the second bag, the mechanical linking member extending through the first and second hollow expandable members.

18. An actuator comprising the combination of claim 16 or 17 wherein the fluid tight extensible hollow member comprises a bellows.

19. An actuator comprising the combination of claim 16 or 17 wherein the fluid tight extensible hollow member comprises a first linear hollow sleeve having spaced opposite ends and a second linear hollow sleeve having spaced opposite ends, the one end of the first sleeve being sealed on the one end of a bag and the other end of the other sleeve being sealed on the other end of said bag, the first and second sleeves being coaxially disposed and the other end of the second sleeve extending into the first sleeve, and a sealing ring mounted on one of the sleeves and disposed between the inner surface of the first sleeve and the outer surface of the second sleeve, the first and second sleeves being translatable with respect to each other.

* * * * *